United States Patent [19]

Akkerman

[11] 3,989,303

[45] Nov. 2, 1976

[54] TUNNELING MACHINE

[76] Inventor: Donald H. Akkerman, Brownsdale, Minn. 55918

[22] Filed: Dec. 8, 1975

[21] Appl. No.: 638,231

[52] U.S. Cl. ..... 299/31; 175/94; 175/99; 299/33

[51] Int. Cl.[2] ..... E21D 9/10

[58] Field of Search ..... 299/30, 31, 33, 56, 299/58; 175/94, 61, 230, 99

[56] References Cited

UNITED STATES PATENTS

| | | | |
|---|---|---|---|
| 902,517 | 10/1908 | Wittich | 175/230 X |
| 3,301,600 | 1/1967 | Pirrie et al. | 299/58 X |
| 3,376,942 | 4/1968 | Van Winkle | 175/94 X |
| 3,411,826 | 11/1968 | Wallers et al. | 299/31 |
| 3,672,726 | 6/1972 | House | 299/31 |
| 3,905,645 | 9/1975 | Bland | 299/31 |

FOREIGN PATENTS OR APPLICATIONS

| | | | |
|---|---|---|---|
| 1,370,735 | 7/1964 | France | 175/94 |

*Primary Examiner*—Ernest R. Purser
*Attorney, Agent, or Firm*—Merchant, Gould, Smith, Edell, Welter & Schmidt

[57] ABSTRACT

A normally generally horizontal cylindrical open-ended casing having a cylindrical rotor coaxially mounted therein for rotary and axial movements, the rotor having a rear end forwardly spaced from the rear end of the casing and a boring head on its front end projecting forwardly of the front end of the casing. At least one motor is mounted in the casing for imparting rotation to the rotor. A pair of fins are mounted in the casing for movements radially through openings in the casing to engage earth material to control rotation of the casing on its axis in the ground. Fluid pressure rams operate to impart limited axial movements to the rotor and boring head relative to the casing and radially extending and retracting movements to the fins. Controls for the rams and motor provide for common operating pressures to the rams and motor.

11 Claims, 7 Drawing Figures

TUNNELING MACHINE

This invention relates to earth boring machines of the type utilized for boring or tunneling through the earth in generally horizontal or sloping directions, and is in the nature of an improvement on structures of the type disclosed in my prior U.S. Letters Pat. No. 3,307,876.

SUMMARY OF THE INVENTION

An important object of this invention is a tunneling machine in which a rotor and its boring head may be moved axially relative to the casing in which it is mounted, so as to reduce the amount of weight of machinery required to be moved axially during a boring operation or cycle.

Another object of this invention is the provision of generally radially extensible and retractable stabilizer fins for biting into the earth or ground material exterior of the casing to counteract the tendency of contra-rotation of the casing during boring rotation of the boring head.

Another object of this invention is the provision of controls by means of which common operating thrust pressures are applied to the rotor driving and feeding mechanisms and to mechanism for radially extending the fins, to compensate for differences in hardness of ground material traversed by the machine.

To the above ends, I provide a cylindrical open-ended casing and a cylindrical rotor mounted in the casing coaxially therewith for rotary and axial movements therein. The rotor has a front end on which is mounted a boring head that projects axially outwardly from one end of the casing, and a rear end axially inwardly spaced from the opposite end of the casing. At least one drive motor is mounted in the casing between said opposite end and the rear end of the rotor for common axial movements with the rotor and for imparting rotation to the rotor. Power operated feeding means, mounted in the casing, impart axial movements to the rotor and boring head. A pair of stabilizer fins are mounted at diametrically opposite portions within the casing rearwardly of the rotor for generally radial movements inwardly and outwardly of the casing; and powered elements are operative to radially extend the fins. Control elements are operative to provide for common operating thrust or effort to the driving motor, rotor feeding means, and said powered elements for the stabilizer fins.

DETAILED DESCRIPTION OF THE PREFERRED EMBODIMENT

Figure 1:
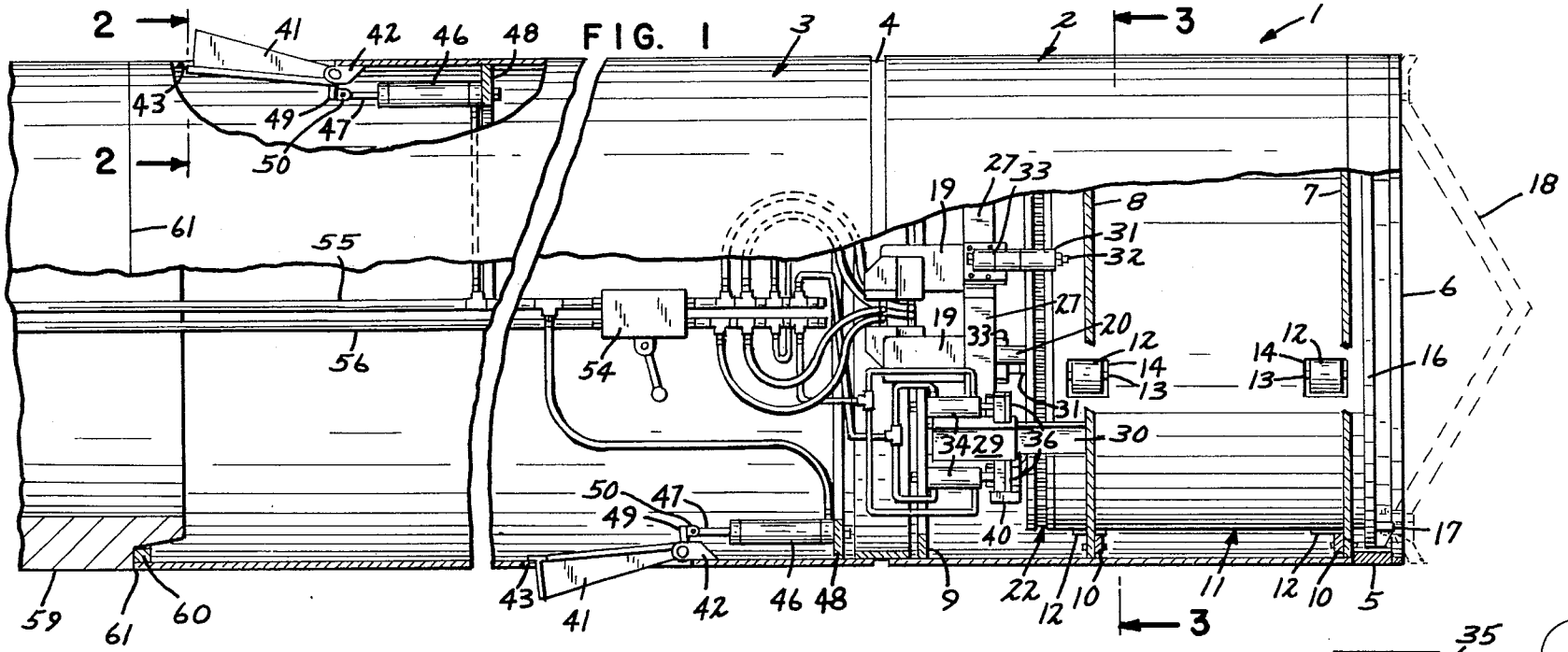
FIG. 1 is a view in side elevation of a tunneling machine produced in accordance with this invention, some parts being broken away and some parts being shown in section.
Figure 7:
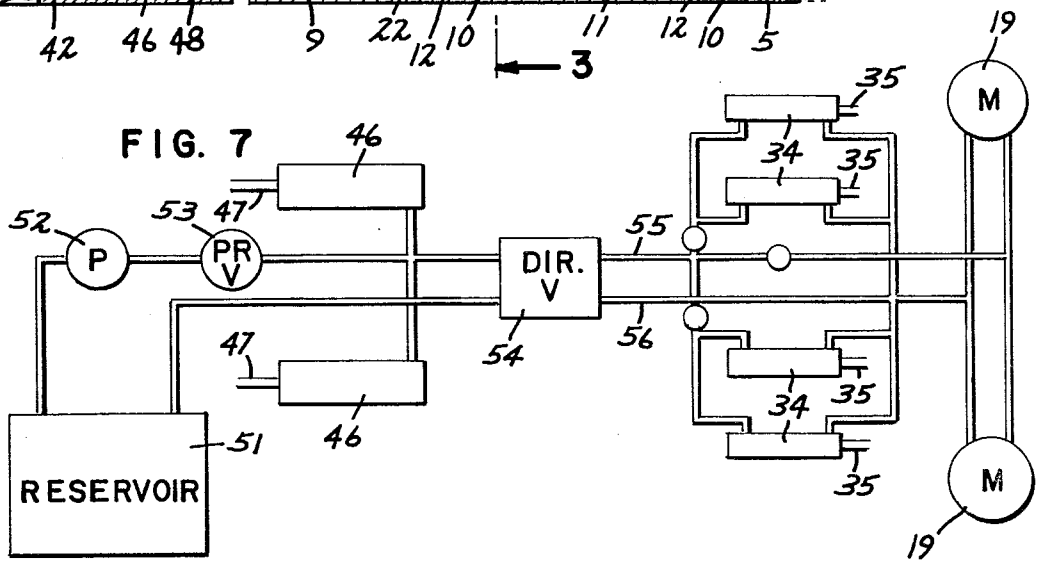
FIG. 7 is a fluid diagram.

An open-ended cylindrical casing, indicated in its entirety by the reference numeral 1, is shown as comprising front and rear casing sections 2 and 3 joined in axially aligned relationship by an annular band 4. The front end of the casing section 2 includes a relatively heavy reinforcing band 5 and a leader ring 6. A plurality of front, intermediate and rear annular flanges 7–9 respectively are welded or otherwise rigidly secured to the interior surface of the front casing section 2, these adding strength and rigidity to the front casing section 2.

A pair of annular rails 10 are each bolted or otherwise rigidly secured to a different one of the flanges 7 and 8 and support an open-ended cylindrical rotor 11 in coaxial relationship to the casing 1. Front and rear rows of circumferentially spaced supporting rollers 12 are journaled on shafts 13 suitably mounted in the rotor 11 for rolling engagement with respective ones of the rails 10 on axes extending parallel to the common axis of the rotor 11 and casing 1. The rollers 12 project through openings 14 in the rotor 11, for engagement with the rails 10, and are of sufficient axial length to support the rotor 11 on the rails 10 while permitting axial movement of the rotor 11 relative to the casing 1. Within the rotor 11, the support rollers are enclosed in shields 15 bolted or otherwise rigidly secured to the inner surface of the rotor 11, so as to exclude earth from the support rollers 12.

At its front end, the rotor 11 is provided with an annular reinforcing flange 16 which aids in keeping foreign matter from the front rail 10 and adjacent support rollers 12. Mounting ears 17 are also welded to the front end of the rotor 11 for supporting a boring head or blade assembly shown by dotted lines in FIGS. 1 and 4 and indicated at 18. The boring head 18, in and of itself, does not comprise the instant invention. Hence, further detailed showing and description thereof is omitted, in the interest of brevity.

Means for imparting rotation to the rotor 11 and boring head 18 comprises a pair of commercially available fluid pressure operated motors 19 having rotary drive shafts 20 on which are mounted pinions 21 that have intermeshing engagement with a cooperating gear 22. The gear 22 comprises a pair of axially spaced annular members 23 and 24 connected by a plurality of circumferentially spaced cylindrical teeth 25, the gear assembly 22 being held together by machine screws or the like 26 extending axially through the teeth 25. The annular member 23 is welded or otherwise rigidly secured to the rear end of the rotor 11, the members 23 and 24 having outer diameters substantially equal to that of the rotor 11. The cylindrical gear teeth 25 are sufficiently spaced apart to prevent sand and smaller pebbles from becoming lodged therebetween and possibly damaging the teeth of the pinions 21 during operation of the machine.

Figure 3:
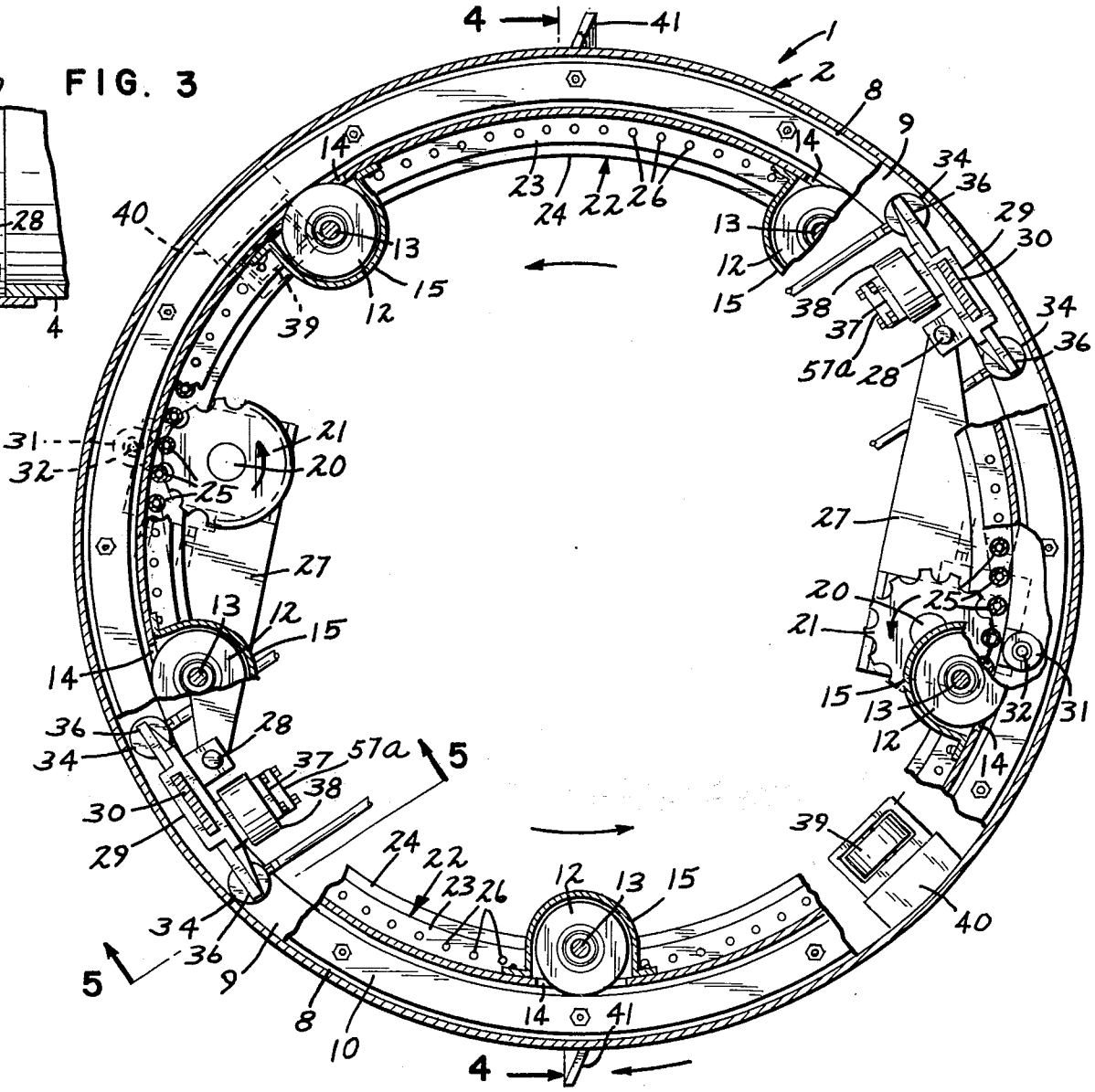
FIG. 3 is an enlarged transverse section taken on the line 3—3 of FIG. 1, some parts being broken away.
Figure 4:
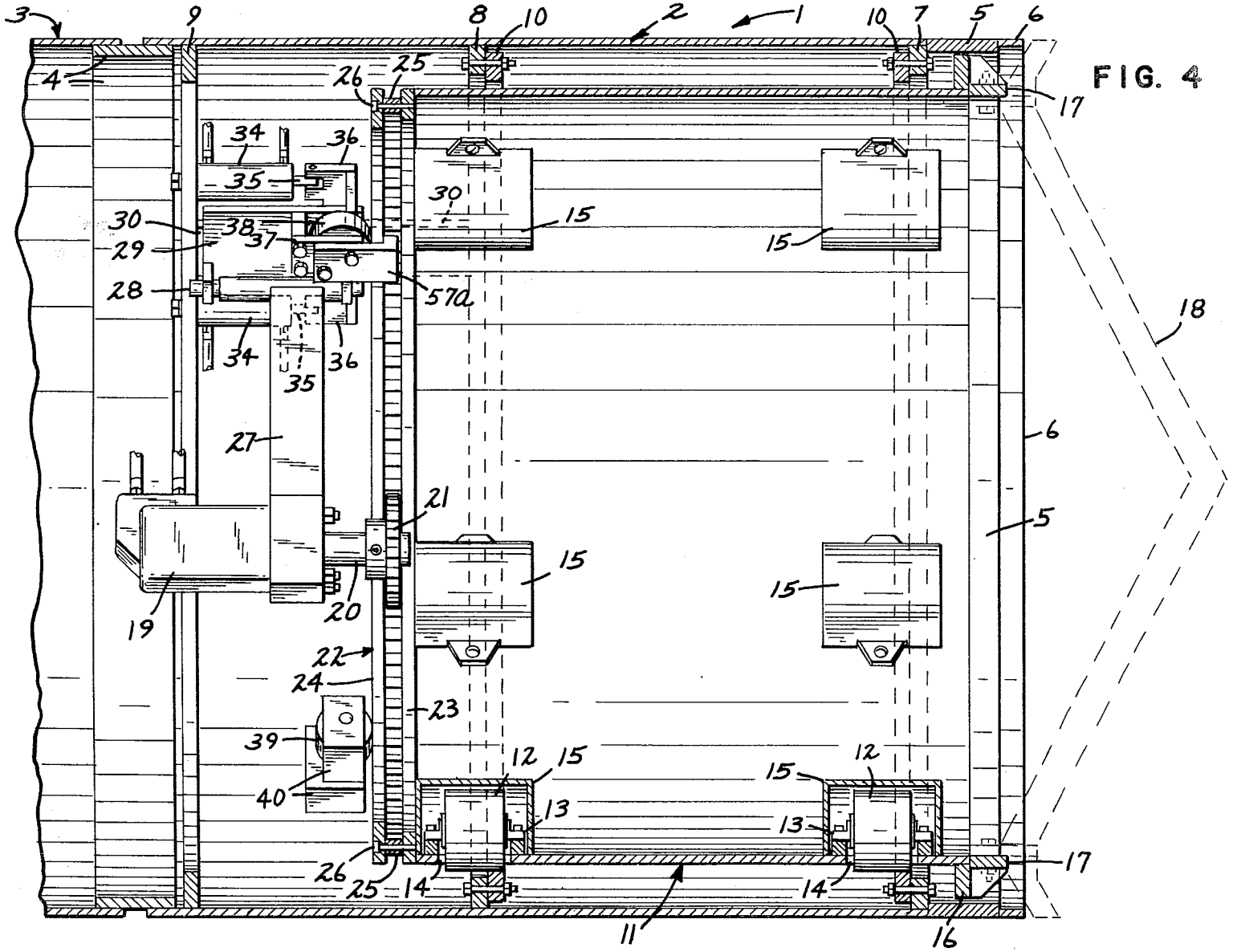
FIG. 4 is an axial section taken on the line 4—4 of FIG. 3, some parts being broken away.

The fluid pressure operated motors 19, as shown particularly in FIG. 3, are disposed in diametrically opposite relationship within the casing 1 and are mounted on one end of a pair of mounting arms 27 that extend generally circumferentially of the casing 1 and which have their inner ends pivotally secured, by shafts 28, to base members 29 that are slidably mounted on plate-like supporting rails 30 that extend in a direction axially with respect to the casing and rotor 11. The rails 30 are each welded or otherwise rigidly secured at their opposite ends to the intermediate annular flange 8 and rear flange 9, as shown in FIGS. 1 and 4. The pinions 21 are held in meshing engagement with the ring gear teeth 25 by retainer rollers 31 journaled on shafts 32 on brackets 33 secured to the mounting arm 27, see FIGS. 1 and 3.

Means for imparting axial movements to the rotor 11 and boring head 18 comprises a plurality of hydraulic rams arranged in circumferentially spaced pairs, one pair for each of the base members 29. Each of the hydraulic rams includes a fluid pressure cylinder 34 and a cooperating piston equipped plunger rod 35, each cylinder 34 being rigidly secured at one end to the rear flange 9, respective plunger rods 35 being connected to laterally outwardly projecting portions 36 of their respective base members 29. Each base member 29 includes a bracket 37 which cooperates with its respective base member 29 to journal a thrust roller 38 which has rolling engagement with the adjacent end surface of the annular member 24. Stop rollers 39 are mounted in brackets 40 suitably secured to the interior of the casing section 2, and are adapted to have rolling engagement with the annular member 24 to limit rearward movement of the rotor 11 and boring head 18. With reference to FIG. 3, it will be seen that the thrust rollers 38 are disposed in generally diametrically opposite relationship, there being a pair of the stop rollers 39, these also being diametrically opposed and circumferentially spaced from the thrust rollers 38. Hook elements 57*a* are secured to the brackets 37 and engage the annular member 24 to impart rearward movement to the rotor 11, when desired.

Figure 2:
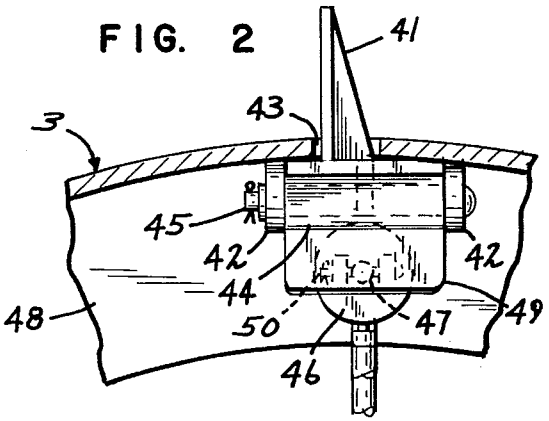
FIG. 2 is an enlarged fragmentary section taken on the line 2—2 of FIG. 1.

During tunnel boring rotation of the rotor 11 and boring head 18, there is a tendency for the casing 1 to partake of contra-rotation relative to the rotor 11. This is particularly true when tunneling through highly resistant ground or earth, such as clay, or stony ground. For the purpose of holding the casing 1 against such contra-rotation, I provide a pair of stabilizing fins 41 that extend generally longitudinally of the casing 1 and which are pivotally mounted at one end to brackets 42 rigidly secured to the interior of the rear casing section 3, for radial movements through slots 43 at diametrically opposite sides of the rear casing section 3. As shown particularly in FIG. 2, the front ends of the stabilizer fins 41 are formed with tubular bearing portions 44 journaled on shafts or pins 45 mounted in the brackets 42. It will further be noted that the stabilizer fins 41 extend longitudinally in directions deviating slightly from a true axial direction of the casing. The fins 41 tend to impart rotation to the casing 1 in the same direction as that of rotation of the rotor 11. This rotation of the casing 1 is controlled by radially outwardly projecting or inwardly retracting the fins 41.

Means for imparting generally radially outward swinging movements to the stabilizer fins 41 comprises a pair of fluid pressure operated cylinder 46 and cooperating piston equipped plunger rods 47. The cylinders 46 are each rigidly secured at one end to a different one of a pair of annular flanges 48 that are welded to the inner cylindrical surface of the rear casing section 3, see particularly FIG. 1. Each of the plunger rods 47 is pivotally secured to the outer end of a lever arm 49 that projects radially outwardly from the tubular bearing 44 of its respective stabilizer fin 41, as indicated at 50.

Figure 5:
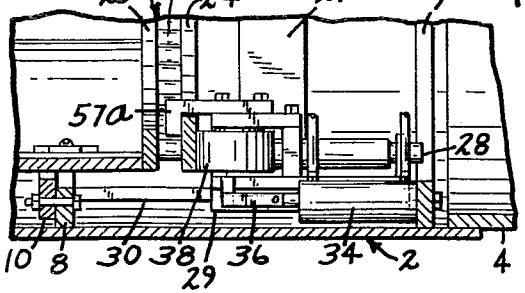
FIG. 5 is a fragmentary section taken on the line 5—5 of FIG. 3.
Figure 6:
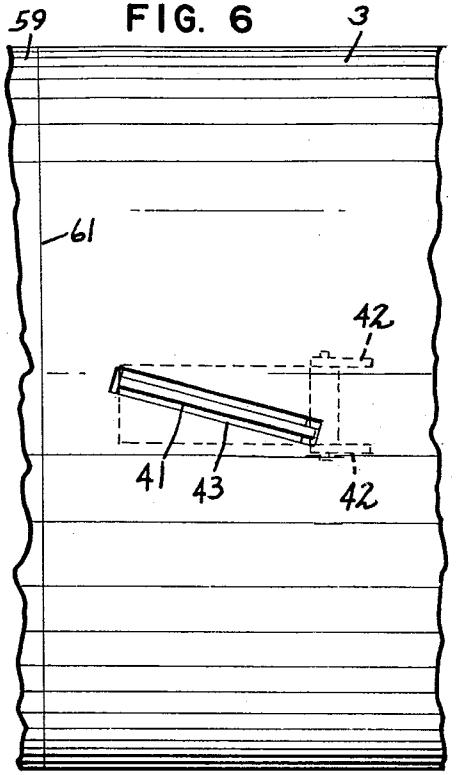
FIG. 6 is a fragmentary view in top plan.

With reference to FIGS. 1 and 5, it will be seen that the fluid operated motors 19 and fluid pressure operated cylinders 34 and 46 are disposed in a fluid circuit including a fluid reservoir 51, a pump 52, a pressure regulator valve 53, a directional control valve 54. The motors 19 and cylinders 34 are connected in a parallel circuit arrangement to conduits 55 and 56, these being alternately pressure and return conduits depending on the disposition of the directional control valve 54. The construction of the valves 53 and 54, shown diagramatically in FIG. 5, is well-known, these valves being available on the market. Detailed description of the structure of the valves 53 and 54 is not believed necessary and is omitted. It should suffice to state that the valve 53 regulates the pressure of fluid directed to the motors 19 and cylinders 34 and 46, the valve 54 controlling the direction of rotation of the motor shafts 20 as well as the direction of movement of the plunger rods 35. Other valves 57 control operation of the cylinders 34, and a valve 58 is used to control operation of the motors 19, the valves 57 and 58 cooperating with the valve 54.

In FIG. 1, a portion of tubular tunnel section is shown fragmentarily and indicated at 59. As shown, the rear end of the rear casing section 3 is provided with an annular reinforcing ring 60 which abuts the front end portion or shoulder 61 of the tunnel section 57.

In operation, the casing 1 and portions carried thereby are held against rearward movement in the ground and are moved forwardly in the usual manner, such as by jacks or other means, not shown, applied to the rear end of a tunnel section such as the tunnel section 59, as disclosed in my prior U.S. Pat. No. 3,307,876. The valve 54 is operated to permit fluid under pressure to flow to the motors 19 to impart boring rotation to the rotor 11 and boring head 18 during forward feeding movement of the rotor and boring head. The fins 41, being subject to fluid pressure in the conduit 55, move radially outwardly into the earth around the casing 1, and tend to impart rotary movement to the casing 1 in the direction of rotation of the rotor 11, and at a very low rate of speed relative to the speed of rotation of the rotor. This rotary movement of the casing is sufficient to offset the tendency of the casing to partake of counter rotation when the rotor 11 and boring head 18 are under cutting or bore load. The fin operating cylinders 46, as well as the motors 19 are under full line pressure, as determined by the valve 53, at all times during operation of the machine. The pressure utilized to operate the motors 19 and cylinders 46, to the line pressure limit, is determined by the character of the earth being bored. When working in heavy earth, such a clay, more power is used by the motors 19 and cylinders 46 than when working in sand or gravel.

In the event that stones or other obstructions, sufficiently large to stall the motors 19, are encountered, the means, not shown, for advancing the tunnel sections and boring machine, are deenergized. The operator then operates the valve 58 to deenergize the motors 19, or manipulates the valve 54 to reverse the motors 19. By manipulating the valves 57, the rotor 11 and cutter head may be retracted by the hook elements 37*a* relative to the casing 1 to free the cutter head from the obstruction, which may then be broken up into pieces for easy handling. By carefully advancing the rotor through manipulation of the valves 57, while the rotor is rotating, the obstruction may often be broken up by the cutter head. When the obstruction is broken up and removed, boring may proceed as before. In view of the fact that the drive motors 19, feeding cylinders 34 and fin operating cylinders 46, as well as the operating valves 53 and 54, are all disposed in close proximity to the inner wall surface of the casing, there is sufficient room within the apparatus for a suitable belt or other conveyor, such as that shown in my prior patent above identified, for removal of earth material bored out by the boring head 18.

It will be appreciated that, should the boring head 18 encounter a particularly hard area of ground, such a clay, or ground containing large stones, increased pressure is required to rotate the rotor and boring head, as well as to feed the rotor and boring head forwardly. When the pressure is increased, an equal increase in pressure is applied to the stabilizer fins 41 in an outward direction, to cause the casing 1 to be more firmly gripped by the ground material adjacent the fins 41, so that the casing 1 is held against contra-rotation.

While I have shown and described a commercial embodiment of tunneling machine, it will be understood that same is capable of modification without departure from the spirit and scope of the invention, as defined in the claims.

What is claimed is:

1. A tunneling machine comprising:

a. a cylindrical open-ended casing normally disposed on a generally horizontal axis;

b. a cylindrical rotor disposed in said casing coaxial therewith and having a front end disposed adjacent one end of the casing and a rear end axially inwardly spaced from the opposite end of the casing;

c. means mounting the rotor for rotation on its axis in the casing and for axial movements relative to the casing;

d. boring means mounted on the front end of said rotor and projecting forwardly of the casing for common movements with the rotor relative to the casing;

e. motor means for imparting rotary movements to the rotor and boring means;

f. advancing and retracting means for imparting axial movements to said rotor element and boring means relative to said casing element;

g. motor mounting means mounting said motor means in said casing for driving engagement with said rotor and for common axial movements with said rotor;

h. a pair of stabilizing fins extending generally longitudinally of said casing and projecting radially with respect to said casing;

i. means mounting said fins on said casing for radial extending and retracting movements relative to said casing;

j. fin projecting means for imparting said radial movements to the fins;

k. and control means for said rotor driving means, feeding means and fin projecting means operable to provide common operating thrust to said motor means and fin projecting means, and independent operating thrust to said advancing and retracting means.

2. The tunneling machine defined in claim 1 in which said means for mounting the rotor in said casing comprises a pair of axially spaced annular rails and a plurality of axially spaced rows of circumferentially spaced support rollers having rolling and axial sliding engagement with respective ones of said rails, said rails and the rollers being mounted on respective ones of said casing and rotor.

3. The tunneling machine defined in claim 1 in which said motor means comprises a pair of motors disposed at diametrically opposite portions of the casing, characterized by intermeshing gears on said motors and rotor.

4. The tunneling machine defined in claim 3 in which said intermeshing gears include relatively small diameter gears on the drive shafts of said motors and a relatively large diameter gear on said rotor, said relatively large diameter gear comprising a pair of axially spaced annular members having outer diameters substantially equal to that of said rotor, one of said annular members being rigidly secured to the rear end of said rotor, and a plurality of circumferentially spaced cylindrical teeth extending axially between said annular members and rigidly secured thereto.

5. The tunneling machine defined in claim 3 in which said motor mounting means comprises a pair of mounting arms extending generally circumferentially of the casing, each arm supporting a different one of said motors, and a pair of base members each mounted for axial sliding movements at diametrically opposite portions of said casing, each of said mounting arms being pivotally mounted on a different one of said base members on an axis extending longitudinally of the casing and said rotor.

6. The tunneling machine defined in claim 5 in which said advancing and retracting means comprises fluid pressure operated rams operatively connected to said casing and said base members, and thrust rollers journalled on said base members and having operative rolling engagement with the rear end of the rotor.

7. The tunneling machine defined in claim 6 characterized by a plurality of circumferentially spaced stop rollers mounted in said casing rearwardly of the rear end of said rotor for limiting rearward axial movement of the rotor.

8. The tunneling machine defined in claim 1 in which said means mounting the stabilizing fins on said casing comprises a pair of mounting brackets pivotally supporting said fins adjacent one of the ends of the fins and rigidly mounted within said casing, said casing having a pair of longitudinally extending slots adjacent said brackets for reception of said fins.

9. The tunneling machine defined in claim 8 in which said fin projecting means comprises a pair of fluid pressure operated rams each operatively connected to said casing and to a different one of said fins.

10. The tunneling machine defined in claim 1 in which said motor means comprises a pair of fluid pressure operated motors, said advancing and retracting means and fin projecting means including fluid pressure operated rams mounted in said casing and operatively engaging respective ones of said rotor and said fins, characterized by a fluid circuit including said motors and rams and a pump.

11. The tunneling machine defined in claim 10 in which said control means comprises a pressure regulating valve and a directional control valve in said fluid circuit, said valves being disposed to cause delivery of fluid to said motors and rams at common given pressures.

* * * * *